US011521783B2

(12) United States Patent
Tsukada et al.

(10) Patent No.: US 11,521,783 B2
(45) Date of Patent: Dec. 6, 2022

(54) REACTOR INCLUDING OUTER IRON-CORE AND METHOD FOR MANUFACTURING THE SAME

(71) Applicant: Fanuc Corporation, Yamanashi (JP)

(72) Inventors: Kenichi Tsukada, Yamanashi (JP); Tomokazu Yoshida, Yamanashi (JP)

(73) Assignee: Fanuc Corporation, Yamanashi (JP)

( * ) Notice: Subject to any disclaimer, the term of this patent is extended or adjusted under 35 U.S.C. 154(b) by 246 days.

(21) Appl. No.: 16/838,358

(22) Filed: Apr. 2, 2020

(65) Prior Publication Data

US 2020/0357562 A1 Nov. 12, 2020

(30) Foreign Application Priority Data

Apr. 19, 2019 (JP) ..... JP2019-080415

(51) Int. Cl.
*H01F 27/28* (2006.01)
*H01F 27/26* (2006.01)
*H01F 41/02* (2006.01)

(52) U.S. Cl.
CPC ..... *H01F 27/26* (2013.01); *H01F 27/28* (2013.01); *H01F 41/0206* (2013.01)

(58) Field of Classification Search
CPC ..... H01F 27/26; H01F 27/28; H01F 41/0206; H01F 3/14; H01F 27/263; H01F 37/00; H01F 17/04; H01F 27/306; H01F 27/33
See application file for complete search history.

(56) References Cited

U.S. PATENT DOCUMENTS

| | | | | |
|---|---|---|---|---|
| 9,899,135 | B2 * | 2/2018 | Nakanoue | H01F 37/00 |
| 10,600,551 | B2 * | 3/2020 | Yoshida | H01F 3/14 |
| 2016/0260538 | A1 | 9/2016 | Tanaka et al. | |

FOREIGN PATENT DOCUMENTS

| | | | |
|---|---|---|---|
| JP | 51133719 | U | 10/1976 |
| JP | 63152220 | U | 10/1988 |
| JP | 2001291619 | A | 10/2001 |
| JP | 2003224014 | A | 8/2003 |
| JP | 2015142095 | A | 8/2015 |
| JP | 2016119419 | A | 6/2016 |
| JP | 2018206949 | A | 12/2018 |
| WO | 2015181848 | A1 | 12/2015 |

* cited by examiner

*Primary Examiner* — Tuyen T Nguyen
(74) *Attorney, Agent, or Firm* — RatnerPrestia

(57) ABSTRACT

Provided is a reactor having a core main body that includes an outer peripheral iron core, at least three iron cores, and coils. Between the iron cores adjacent to each other, a gap being magnetically coupled is formed. The reactor includes a fixture that fixes both end portions of the at least three iron cores together by passing through an interior of the outer peripheral iron core in a region between the outer peripheral iron core and the gap. The fixture includes plate-like members disposed on both end faces of the core main body and includes rod-like members that connect the plate-like members to each other by passing through the interior of the outer peripheral iron core. The plate-like members each include a protrusion extending axially inward of the core main body.

5 Claims, 12 Drawing Sheets

REACTOR INCLUDING OUTER IRON-CORE AND METHOD FOR MANUFACTURING THE SAME

CROSS-REFERENCE TO RELATED APPLICATIONS

This application is a new U.S. Patent Application that claims benefit of Japanese Patent Application No. 2019-080415, dated Apr. 19, 2019, the disclosure of this application is being incorporated herein by reference in its entirety for all purposes.

BACKGROUND OF THE INVENTION

1. Field of the Invention

The present invention relates to a reactor including an outer peripheral iron core and a method for manufacturing the same.

2. Description of the Related Art

In recent years, a reactor has been developed that include an outer peripheral iron core and a plurality of iron-core coils disposed inside the outer peripheral iron core. Each of the plurality of iron-core coils includes an iron core and a coil wound around the iron core.

JP 2018-206949 A discloses that a reactor that includes a fixture that fixes both end portions of a plurality of iron cores to each other by passing through an interior of an outer peripheral iron core, the fixture including plate-like members disposed on both end faces of the outer peripheral iron core and including rod-like members that connect the plate-like members to each other by passing through the interior of the outer peripheral iron core.

SUMMARY OF THE INVENTION

However, J P 2018-206949 A has a problem in that when two plate-like members are rigidly connected to each other with the rod-like members, the plate members may be bent. In this case, gaps are formed between each of the plurality of iron cores and the respective plate-like members to cause insufficient fixing of the plurality of iron cores. As a result, when the reactor is used, the plurality of iron cores may vibrate to cause noise.

Thus, there is a desire for a reactor capable of firmly holding a plurality of iron cores without generating vibration and noise, and a method for manufacturing the same.

According to a first aspect of the present disclosure, there is provided a reactor including a core main body, the core main body having: an outer peripheral iron core composed of a plurality of outer peripheral iron core portions; at least three iron cores coupled to inner faces of the plurality of outer peripheral iron core portions; and coils wound around the respective at least three iron cores, the at least three iron cores respectively having radial inner end portions positioned near a center of the outer peripheral iron core, converging toward the center of the outer peripheral iron core, a gap being formed between one iron core of the at least three iron cores and another iron core adjacent to the one iron core, the gap being magnetically coupled, the radial inner end portions of the at least three iron cores being spaced apart from each other with the gap being magnetically coupled, the reactor further including a fixture that fixes both end portions of the at least three iron cores together by passing through an interior of the outer peripheral iron core in a region between the outer peripheral iron core and the gap, the fixture having: plate-like members disposed on both end faces of the core main body; and rod-like members connecting the plate-like members to each other by passing through the interior of the outer peripheral iron core, and the plate-like members each including a protrusion extending axially inward of the core main body.

In the first aspect, the protrusion extends axially inward of the core main body. Thus, even when the rod-like members and the plate-like members are connected, the plate-like members are less likely to easily bend. Accordingly, the plurality of iron cores can be firmly held while the generation of vibration and noise is suppressed.

The objects, features and advantages of the present invention will become more apparent from the description of the following embodiments in connection with the accompanying drawings, wherein:

DETAILED DESCRIPTION

Figure 1:
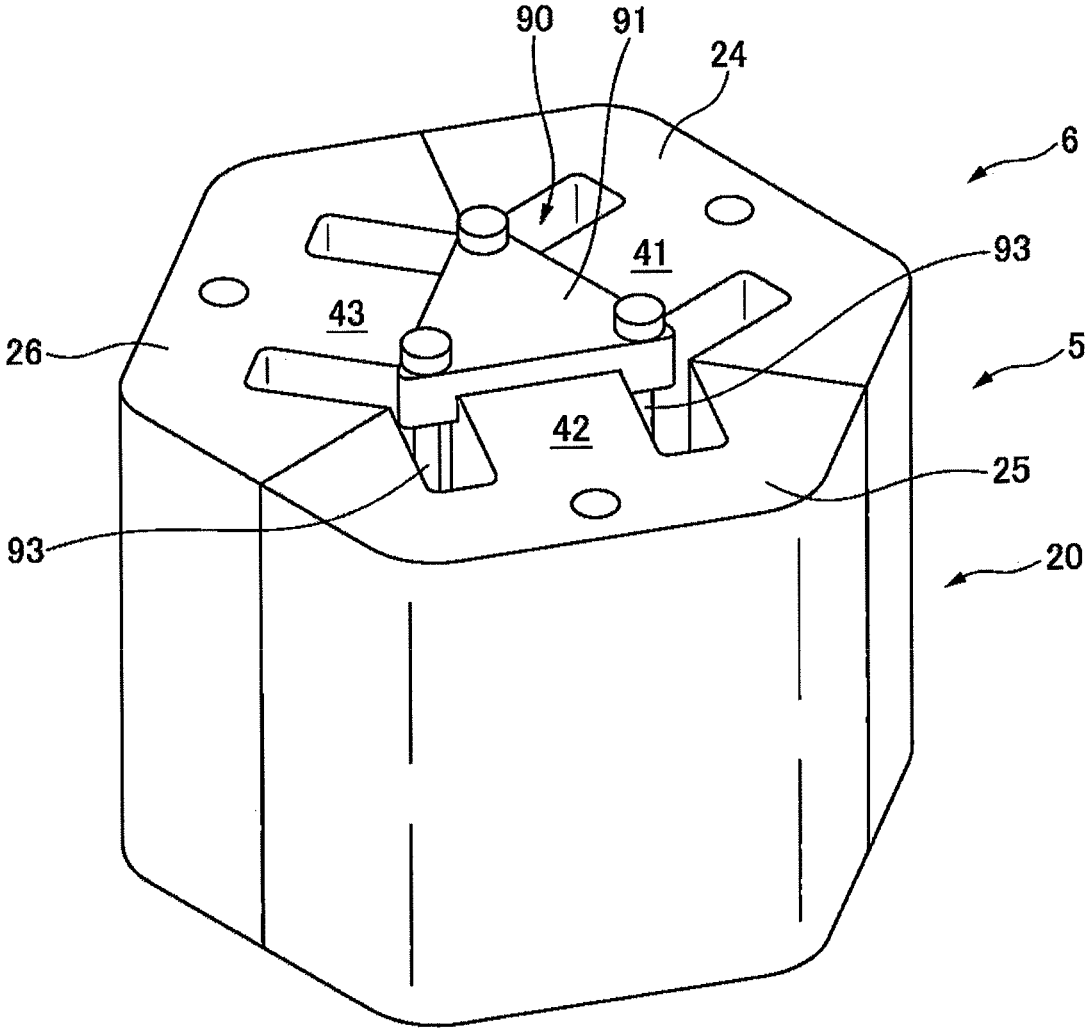
FIG. 1 is a perspective view of a reactor according to a first embodiment.

Embodiments of the present invention will be described below with reference to the accompanying drawings. Throughout the drawings, corresponding components are denoted by common reference numerals.

While in the following description, the three phase reactors are primarily described by way of example, an application of the present disclosure is not limited to a three-phase reactor and the present disclosure is widely applicable to a multi-phase reactor in which a constant inductance is required for each phase. In addition, the reactor according to the present disclosure is not limited to that provided on a primary side and a secondary side of an inverter in an industrial robot or a machine tool and can be applied to various apparatuses.

Figure 2:
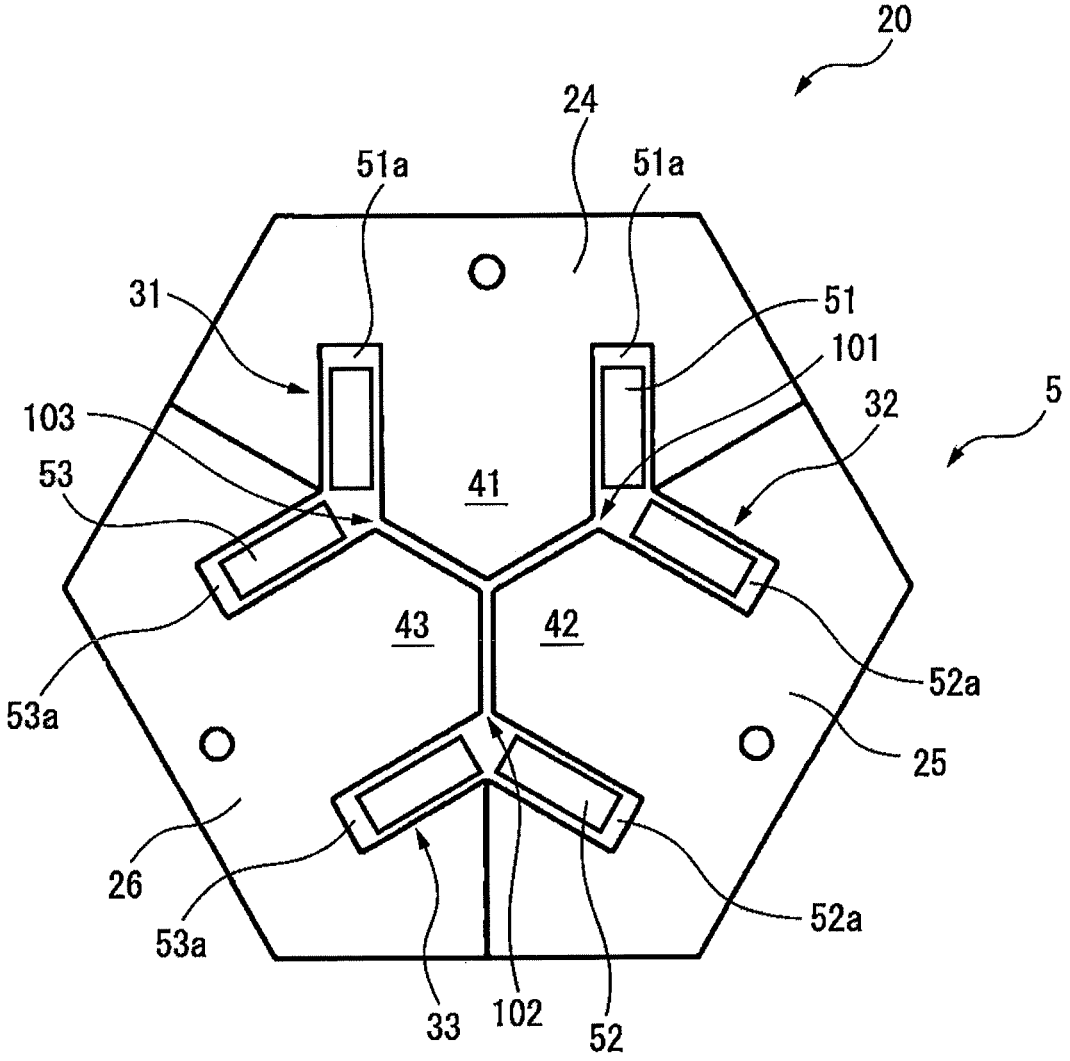
FIG. 2 is a cross-sectional view of a core main body of the reactor according to the first embodiment.

FIG. 1 is a perspective view of a reactor according to a first embodiment. FIG. 2 is a cross-sectional view of a core main body of the reactor according to the first embodiment. As illustrated in FIG. 1 and FIG. 2, a core main body 5 of a reactor 6 includes an outer peripheral iron core 20 and three iron core coils 31 to 33 disposed inside the outer peripheral iron core 20. In FIG. 1, the iron core coils 31 to 33 are disposed inside the outer peripheral iron core 20 in a substantially hexagonal shape. These iron core coils 31 to 33 are arranged at equal intervals in a circumferential direction of the core main body 5.

The outer peripheral iron core 20 may have another rotationally symmetric shape, e.g., a circular shape. Additionally, the number of iron core coils may be a multiple of three. In that case, the reactor 6 can be used as a three-phase reactor.

As can be seen from the drawing, the iron core coils 31 to 33 respectively includes iron cores 41 to 43 extending only radially of the outer peripheral iron core 20; and coils 51 to 53 wound around the corresponding iron cores. In FIG. 1 and another drawing described below, the illustration of the coils 51 to 53 is eliminated for the sake of simplicity.

The outer peripheral iron core 20 is composed of a plurality of outer peripheral iron core portions, e.g., three outer peripheral iron core portions 24 to 26 divided in the circumferential direction. The outer peripheral iron core portions 24 to 26 are formed integrally with the iron cores 41 to 43, respectively. The outer peripheral iron core portions 24 to 26 and the iron cores 41 to 43 are each formed by stacking a plurality of steel plates, carbon steel plates, or electromagnetic steel plates or are formed of a dust core. Forming the outer peripheral iron core 20 with the plurality of outer peripheral iron core portions 24 to 26 as described above enables, even when the outer peripheral iron core 20 is large, the outer peripheral iron core 20 described above to be easily manufactured. The number of iron cores 41 to 43 and the number of outer peripheral iron core portions 24 to 26 may not be necessarily equal to each other.

The coils 51 to 53 are disposed in coil spaces 51*a* to 53*a* formed between the outer peripheral iron core portions 24 to 26 and the corresponding iron cores 41 to 43. In the coil spaces 51*a* to 53*a*, inner circumferential faces and outer circumferential faces of the coils 51 to 53 are adjacent to inner walls of the coil spaces 51*a* to 53*a*.

In addition, each of the radial inner end portions of the iron cores 41 to 43 is positioned near the center of the outer peripheral iron core 20. In the drawing, the radial inner end portion of each of the iron cores 41 to 43 converges toward the center of the outer peripheral iron core 20 and has a tip angle of about 120 degrees. The radial inner end portions of the iron cores 41 to 43 are spaced apart from each other with gaps 101 to 103 being magnetically coupled.

In other words, the radial inner end portion of the iron core 41 is spaced apart from the radial inner end portions of the respective two adjacent iron cores 42 and 43 with the gaps 101 and 102. The same applies to the other iron cores 42 and 43. The gaps 101 to 103 are equal to each other in dimension.

As described above, the configuration illustrated in FIG. 1 does not require a center core positioned at the center of the core main body 5, so the core main body 5 can be reduced in weight and formed easily. In addition, the three iron core coils 31 to 33 are surrounded by the outer peripheral iron core 20, so magnetic fields generated from the coils 51 to 53 do not leak from the outer peripheral iron core 20 to the outside. The gaps 101 to 103 can be provided at any thickness and at a low cost, so it is advantageous in design compared to reactors with configurations in the related art.

In addition, the core main body 5 of the present disclosure has a difference in magnetic path length between phases that is less than that in reactors with configurations in the related art. Thus, the present disclosure enables reducing inductance unbalance due to the difference in magnetic path length.

Figure 3:
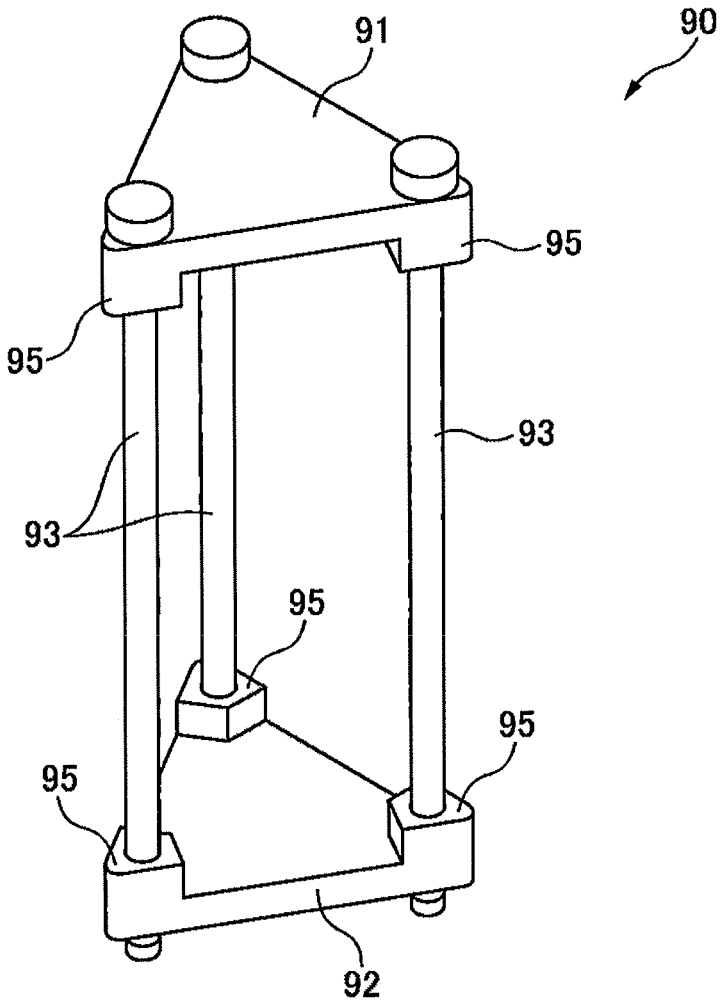
FIG. 3 is a perspective view of a fixture.

Referring again to FIG. 1, a fixture 90 is disposed in the center of an end face of the core main body 5. The fixture 90 serves to fix both end faces of the respective iron cores 41 to 43 in an axial direction of the core main body 5. FIG. 3 is a perspective view of a fixture. As illustrated in FIG. 3, the fixture 90 includes plate-like members 91 and 92 and a plurality of rod-like members 93 that connect the plate-like members 91 and 92 to each other. The fixture 90 preferably has components as described above formed of a non-magnetic material, such as aluminum, SUS, resin, and the like. This prevents a magnetic field from passing through the fixture.

The plate-like members 91 and 92 also may be formed of an insulating material, such as a resin. This case suppresses the generation of heat in the reactor 6 compared to when the plate-like members 91 and 92 are formed of metal. Still, the rod-like member 93 is preferably made of metal. This increases the strength of the rod-like member 93 against tension applied when the rod-like member 93 is fixed, so the fixing of the core can be held more firmly.

As can be seen from FIG. 1, the plate-like members 91 and 92 are disposed on respective end faces of the core main body 5. The plate-like members 91 and 92 each preferably have a triangular shape with an area allowing the gaps 101 to 103 to be covered. This prevents the plate-like members 91 and 92 from interfering with the coils 51 to 53. The plate-like members 91 and 92 each may have another shape. Instead of the plate-like members 91 and 92, other members that support the rod-like member 93, such as a frame body, may be used, for example.

The plurality of rod-like members 93 pass through an interior of the outer peripheral iron core 20 in respective regions between the outer peripheral iron core 20 and the gaps 101 to 103. The rod-like member 93 is slightly larger in height than the core main body 5 (height in a stacking direction). The rod-like member 93 is also provided at both end portions with respective thread parts. This allows each rod-like member 93 to be screwed into a hole formed in the corresponding plate members 91 and 92.

Figure 4:
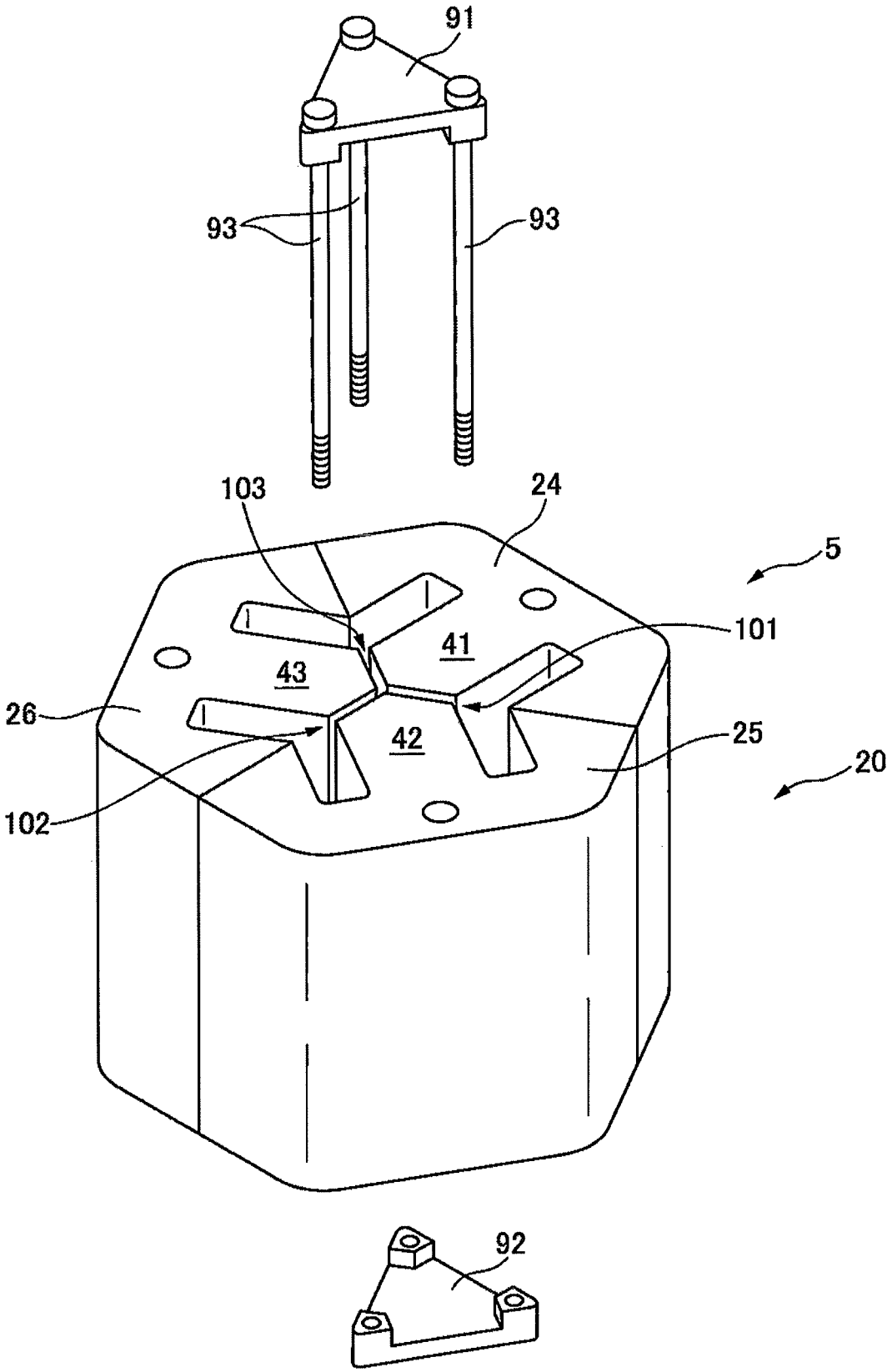
FIG. 4 is a diagram for illustrating attaching of a fixture.

FIG. 4 is a diagram for illustrating attaching of a fixture. As illustrated, the plurality of rod-like members 93 are preliminarily attached to the plate-like member 91. When the fixture 90 is attached to the core main body 5, the plurality of rod-like members 93 are positioned to be disposed in regions between the outer peripheral iron core 20 and the respective gaps 101 to 103.

Then, the plate-like member 91 and the rod-like members 93 are moved toward one end face of the core main body 5 such that the rod-like members 93 pass through the regions between the outer peripheral iron core 20 and the respective gaps 101 to 103. When the plate-like member 91 reaches the one end face of the core main body 5, a leading end of each of the rod-like members 93 protrudes from the other end face of the core main body 5. Then, the plate-like member 92 is disposed on a side of the other end face of the core main body 5, and the rod-like members 93 are each rotated and screwed into the plate-like member 92. To connect the plate-like members 91 and 92 to the rod-like members 93, other fasteners such as screws, bolts, and the like may be used.

As described above, the plate-like members 91 and 92 each have an area allowing the gaps 101 to 103 to be covered. Thus, when the core main body 5 is sandwiched in the axial direction between the plate-like members 91 and 92 with the rod-like members 93, both end portions of the plurality of iron cores 41 to 43 are firmly held together.

With reference to FIG. 3 and FIG. 4, protrusions 95 extends downward in the axial direction of the core main body 5, from respective three corner portions on a bottom face of the plate member 91. Similarly, protrusions 95 extends upward in the axial direction of the core main body 5, from respective three corner portions on a top face of the plate member 92. In other words, the protrusions 95 extend toward an interior of the core main body 5 in the axial direction of the core main body 5. The protrusions 95 each preferably have a length greater than a thickness of the plate-like member 91. The protrusions 95 are preferably integrally formed of the same material as the plate-like members 91 and 92.

Each of the plate members 91 and 92 including the protrusions 95 preferably has the same shape. In addition, the protrusions 95 may be provided only in one of the plate-like members 91 and 92. Further, the protrusion 95 may protrude from at least one of the three corner portions of each of the plate members 91 and 92.

Figure 5:
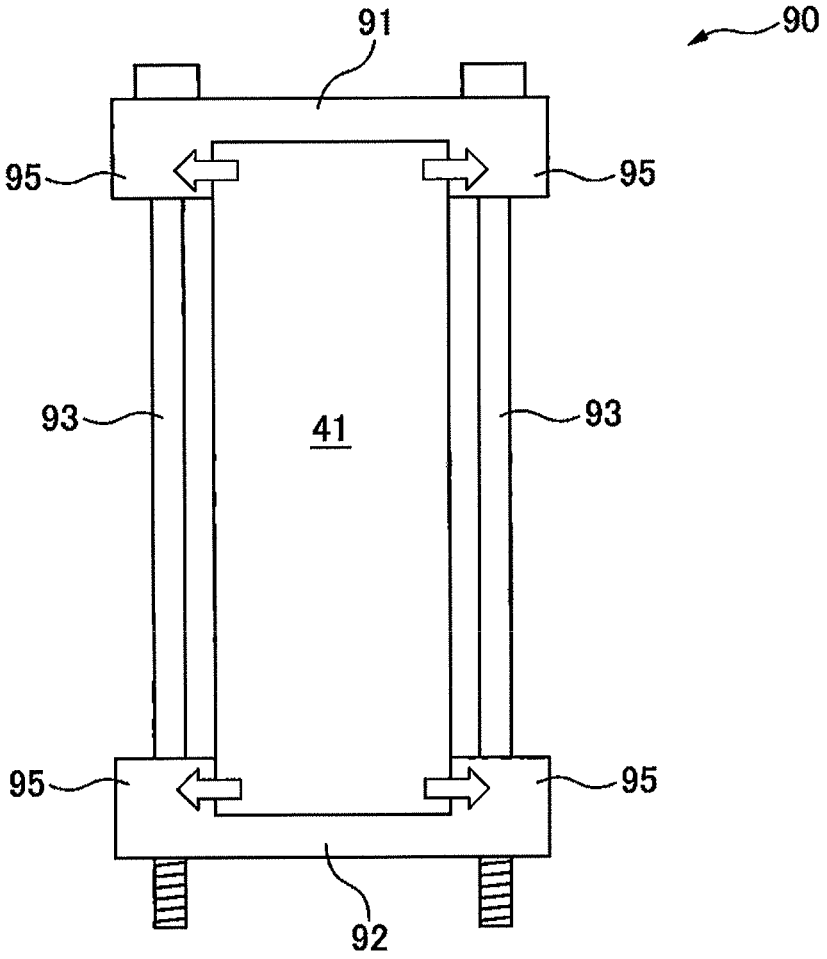
FIG. 5 is a cross-sectional view of a fixture and an iron core.

FIG. 5 is a cross-sectional view of a fixture and an iron core. While FIG. 5 illustrates a case of the iron core 41 as an example, the same applies to other iron cores. As illustrated in FIG. 5, the protrusions 95 extend inward in the axial direction of the core main body 5, so the plate members 91 and 92 are less likely to easily bend even when the rod-like members 93 and the plate-like members 91 and 92, are connected. Thus, the plurality of iron cores 41 to 43 can be firmly held by the fixture 90 while the generation of vibration and noise during use of the reactor 6 is suppressed.

As can be seen from FIG. 4, the single protrusion 95 of the plate-like member 92 has two inner side portions adjacent to each other in a region of the plate-like member 92. The two adjacent inner side portions of the protrusion 95 forms an angle substantially equal to an angle formed by two adjacent iron cores. The protrusion 95 of the plate-like member 91 also has a similar configuration. Thus, as illustrated in FIG. 5, an inner side portion of the protrusion 95 comes into contact with a side face of the iron core 41. This enables the generation of vibration and noise to be further suppressed.

Figure 6:
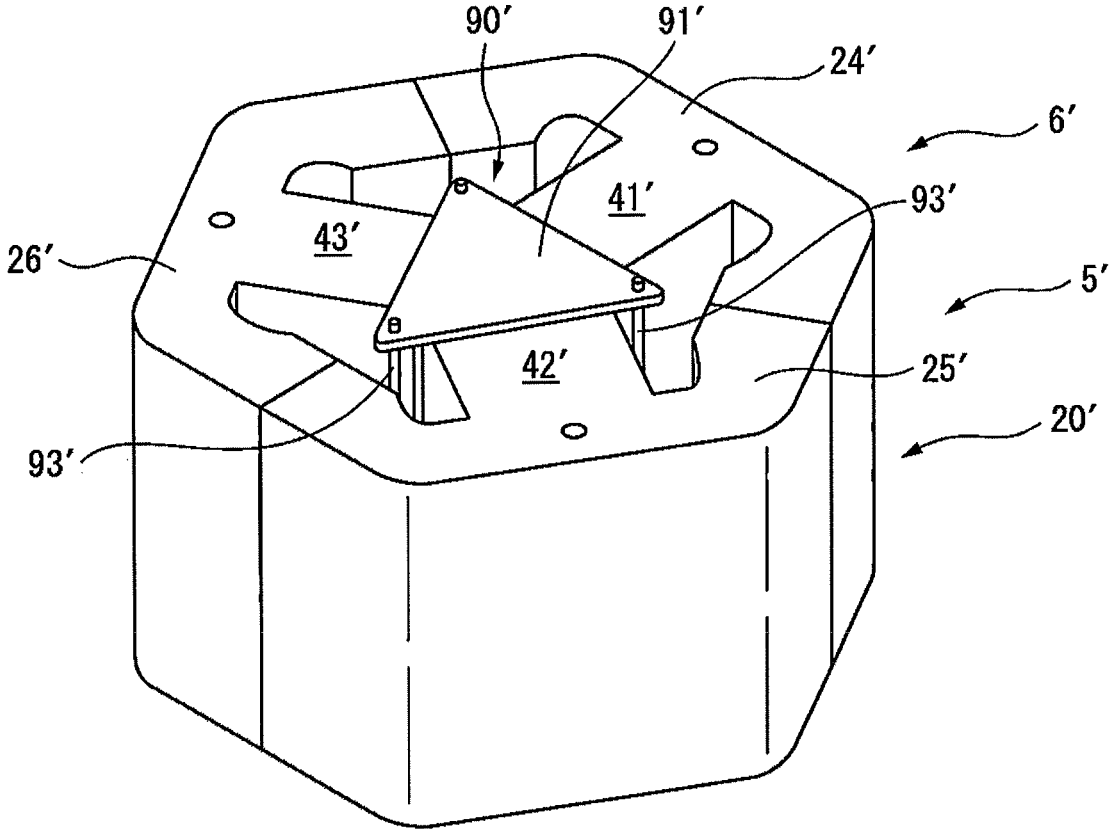
FIG. 6 is a perspective view of a reactor in the related art.
Figure 7:
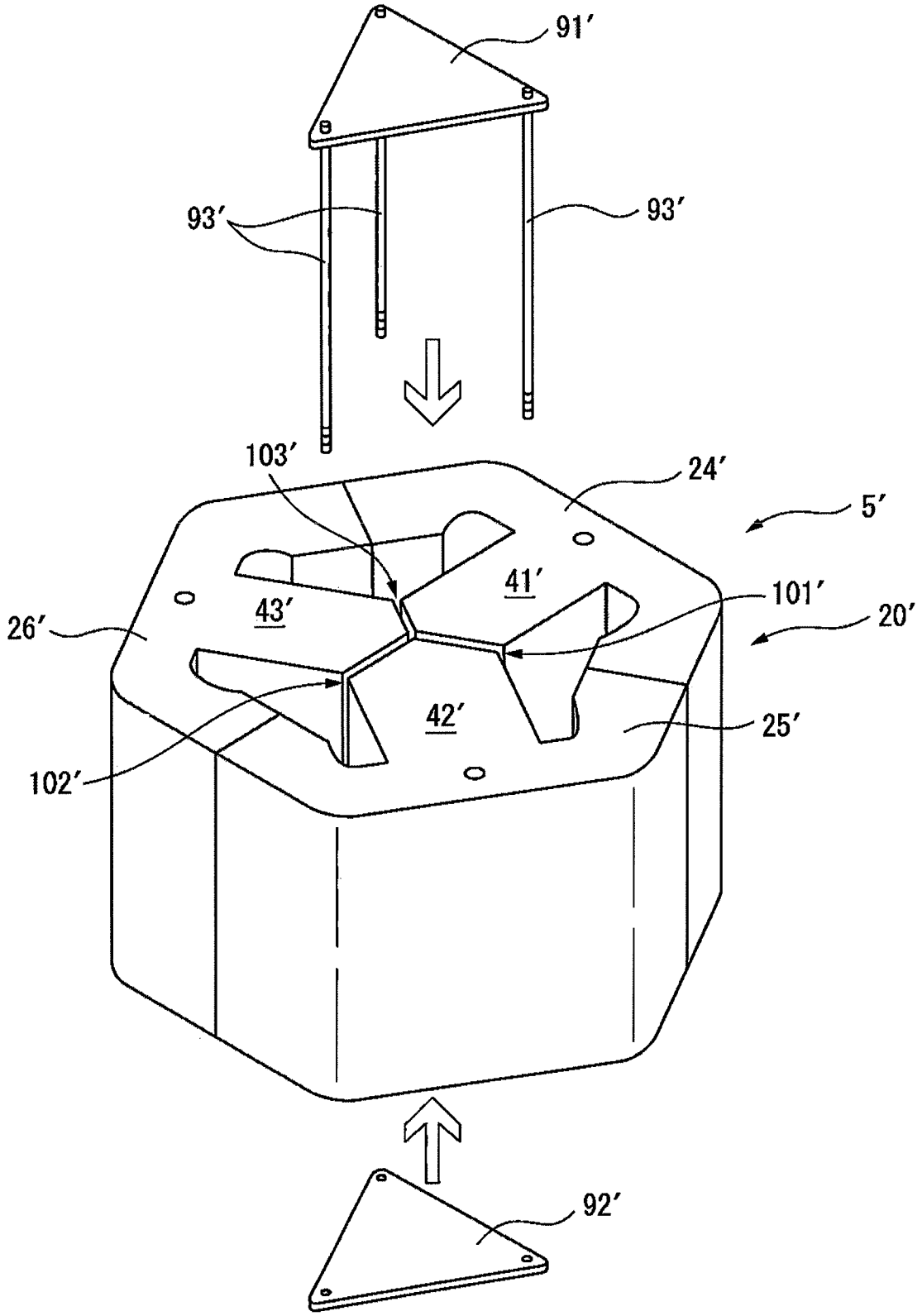
FIG. 7 is a diagram for illustrating attaching of a fixture in the reactor illustrated in FIG. 6.

Then, FIG. 6 is a cross-sectional view of a core main body of a reactor in a related art, and FIG. 7 is a diagram for illustrating attaching of a fixture in the reactor illustrated in FIG. 6. FIG. 6 and the like illustrate a core main body 5' of the reactor of the related art, having a similar configuration to that described with reference to FIG. 2 and the like. In FIG. 6 and the like, members similar to those illustrated in FIG. 2 and the like are denoted by reference signs with "'" added to eliminate duplicated description thereof. In FIG. 6 and FIG. 7, plate-like members 91' and 92' without the protrusion 95 are disposed on respective end faces of the core main body 5' and are connected to each other by rod-like members 93'.

Figure 8:
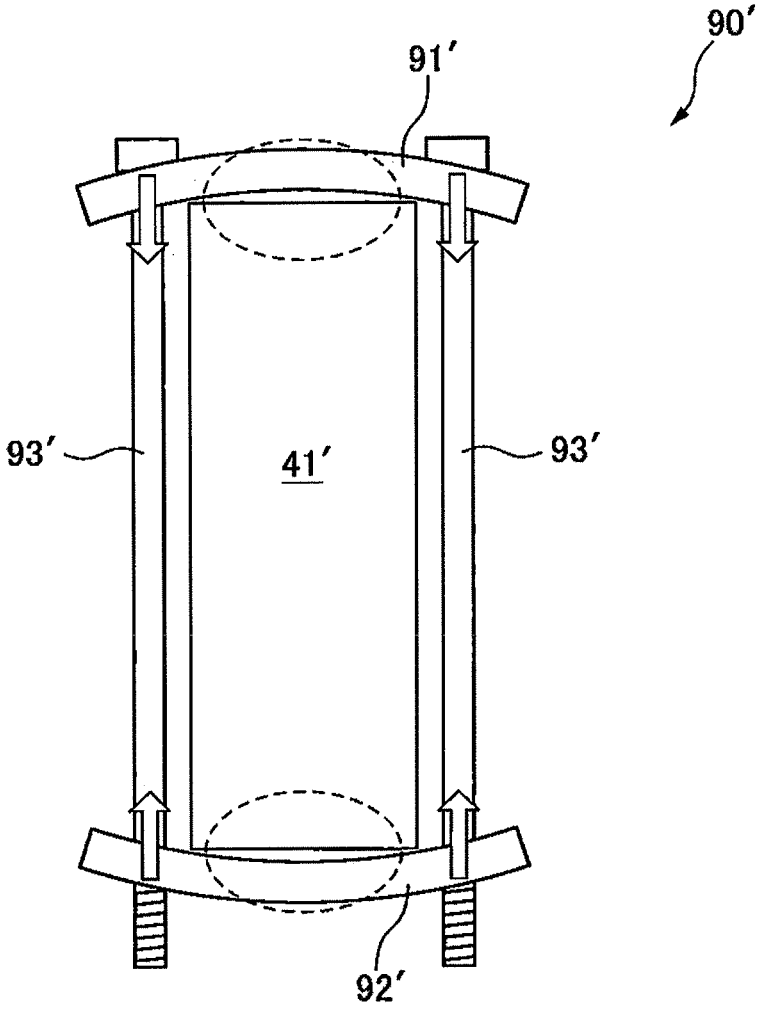
FIG. 8 is a cross-sectional view of a fixture and an iron core in the reactor illustrated in FIG. 6.

FIG. 8 is a cross-sectional view of a fixture and an iron core in the reactor illustrated in FIG. 6 and is a view similar to that of FIG. 5. In FIG. 8, when the plate-like members 91' and 92' are connected to each other by the rod-like member 93', the plate-like members 91' and 92' curve to be convex outward, thereby forming gaps between the plate members 91' and 92' and an iron core 41'. In this case, there is a problem in that fixing the iron core 41 in the center of a reactor 6' is insufficient to result in the generation of vibration and noise. In contrast, in the present invention, the plate-like members 91 and 92 do not curve as described above. Thus, no gap is formed between the plate members 91 and 92 and the iron core 41, so vibration and noise can be suppressed.

Figure 9:
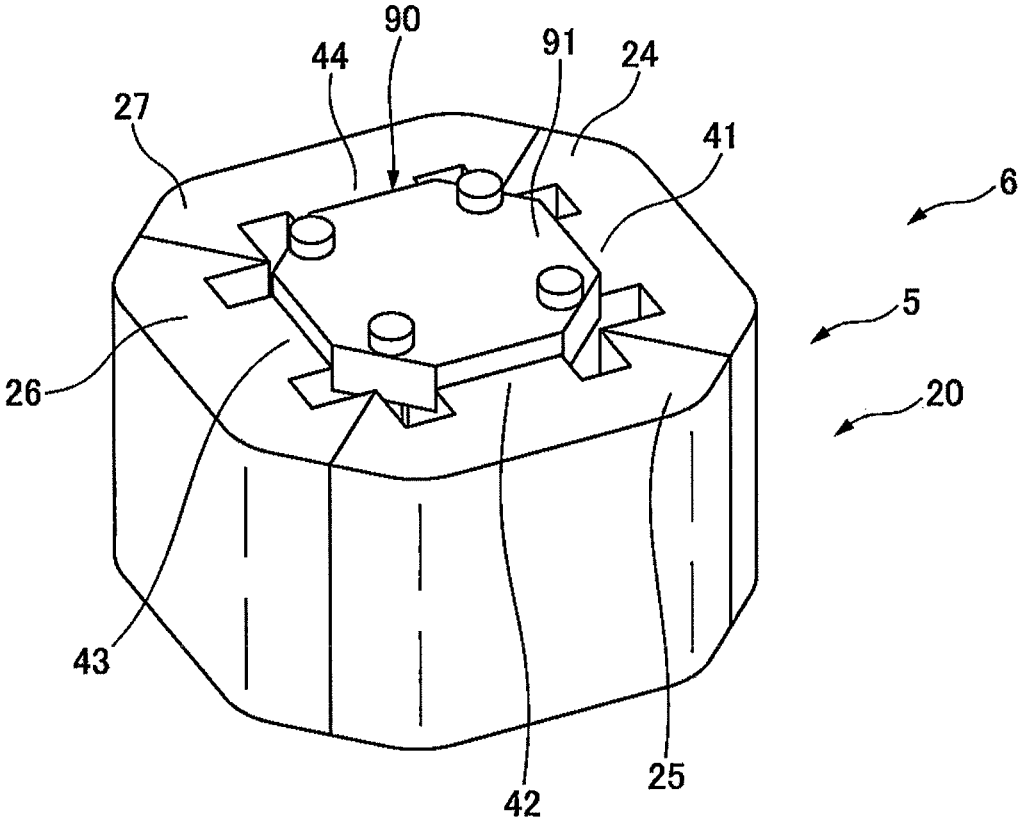
FIG. 9 is a perspective view of a reactor according to a second embodiment.
Figure 10:
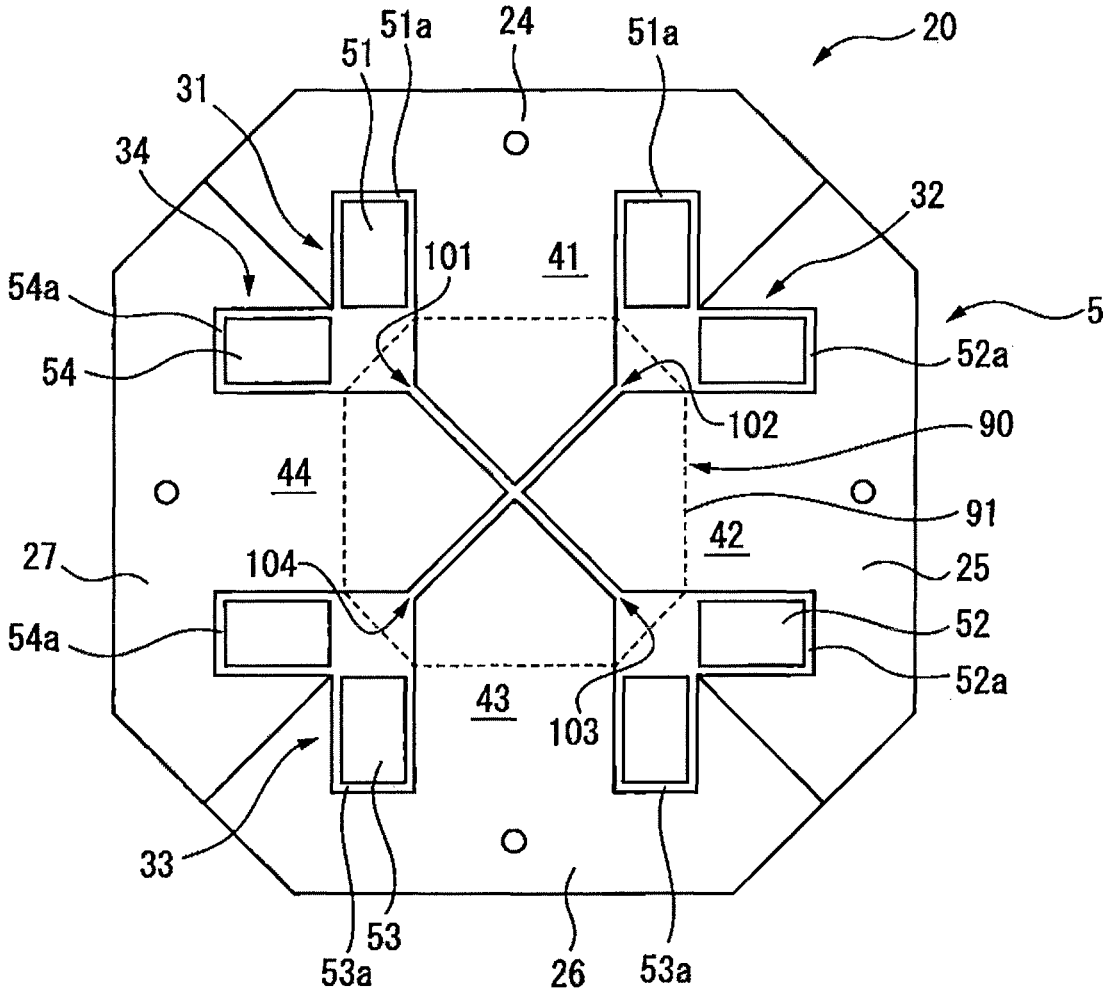
FIG. 10 is a cross-sectional view of a core main body of the reactor according to the second embodiment.
Figure 11:
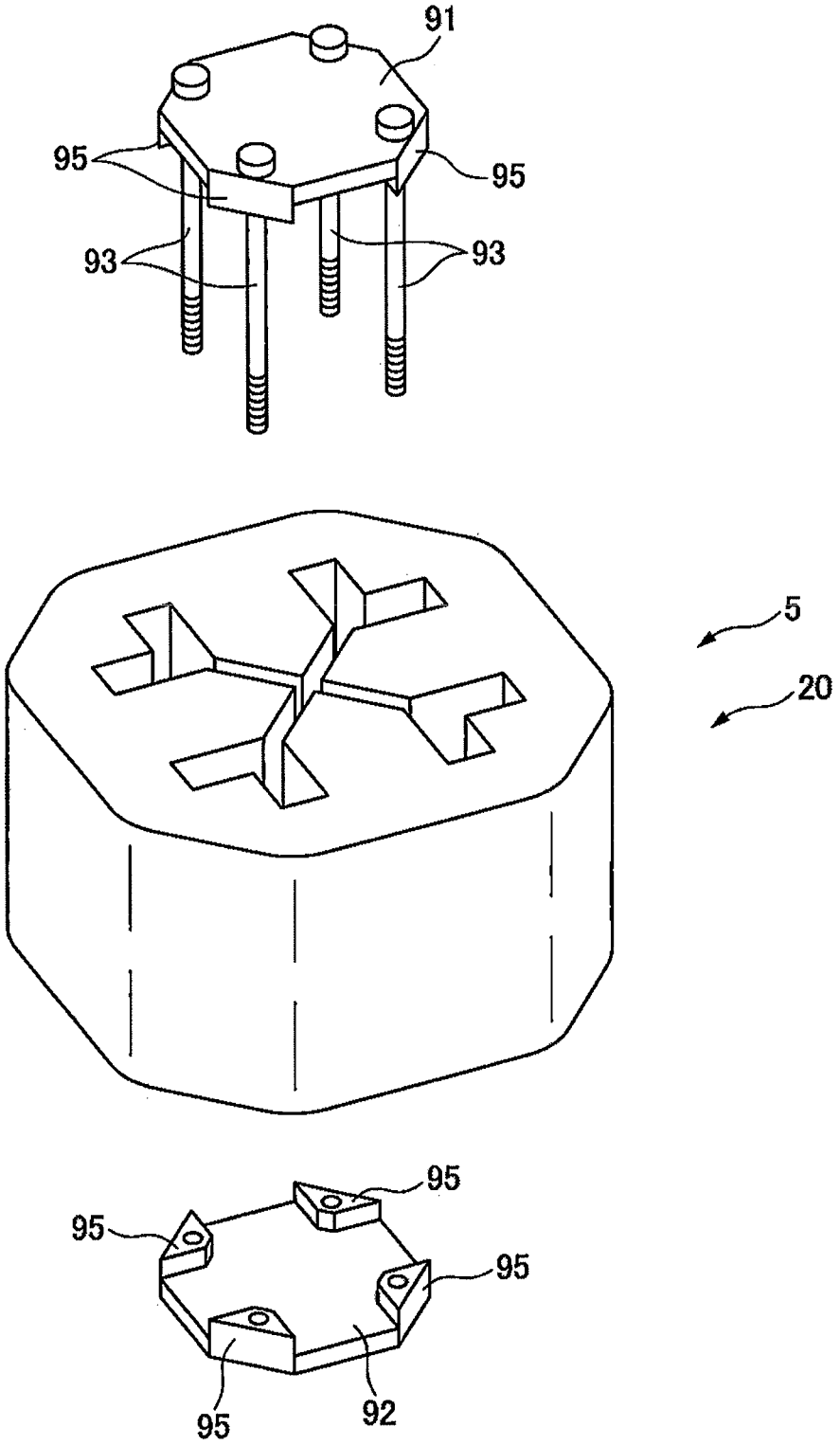
FIG. 11 is a diagram for illustrating attaching of a fixture in the reactor according to the second embodiment.

Then, FIG. 9 is a perspective view of a reactor according to a second embodiment, FIG. 10 is a cross-sectional view of a core main body of the reactor according to the second embodiment, and FIG. 11 is a diagram for illustrating attaching of a fixture in the reactor according to the second embodiment. The core main body 5 illustrated in FIG. 10 includes the outer peripheral iron core 20 in a substantially octagonal shape and four iron core coils 31 to 34, similar to those described above, disposed inside the outer peripheral iron core 20. These iron core coils 31 to 34 are arranged at equal intervals in a circumferential direction of the core main body 5. In addition, the number of iron cores is preferably an even number of four or more, and thus the reactor provided with the core main body 5 can be used as a single-phase reactor.

As can be seen from the drawings, the outer peripheral iron core 20 is formed of four outer peripheral iron core portions 24 to 27 that are circumferentially divided. The iron core coils 31 to 34 respectively include iron cores 41 to 44 extending radially and coils 51 to 54 wound around the corresponding iron cores. The iron cores 41 to 44 each have a radial outer end portion formed integrally with the corresponding outer peripheral iron core portions 21 to 24. The number of the iron cores 41 to 44 and the number of the outer peripheral iron core portions 24 to 27 may not be necessarily equal to each other.

In addition, the iron cores 41 to 44 each have a radial inner end portion positioned near the center of the outer peripheral iron core 20. In FIG. 10, the radial inner end portion of each of the iron cores 41 to 44 converges toward the center of the outer peripheral iron core 20 and has a tip angle of about 90 degrees. The radial inner end portions of the iron cores 41 to 44 are spaced apart from each other with gaps 101 to 104 being magnetically coupled.

The plate-like member 91 illustrated in FIG. 9 has a substantially octagonal shape having an area allowing the gaps 101 to 104 to be covered and has the protrusion 95 similar to that described above, provided in corner portions thereof. The same applies to the plate-like member 92 (not illustrated in FIG. 9). As can be seen from FIG. 11, when the core main body 5 is sandwiched in the axial direction between the plate-like members 91 and 92 with the rod-like members 93, both end portions of the plurality of iron cores 41 to 44 are fixed together.

Even in this case, the protrusions 95 extend inward in the axial direction of the core main body 5, so the plate members 91 and 92 are less likely to easily bend even when the rod-like members 93 and the plate-like members 91 and 92 are connected. Thus, the plurality of iron cores 41 to 43 can be firmly held by the fixture 90 while the generation of vibration and noise during use of the reactor 6 is suppressed.

As can be seen from FIG. 11, the single protrusion 95 of the plate-like member 92 has two inner side portions adjacent to each other in a region of the plate-like member 92. The two adjacent inner side portions of the protrusion 95 forms an angle substantially equal to an angle formed by two adjacent iron cores. The protrusion 95 of the plate-like member 91 also has a similar configuration. Accordingly, as described above, an inner side portion of the protrusion 95 comes into contact with a side face of the iron core 41. This enables the generation of vibration and noise to be further suppressed.

Figure 12:
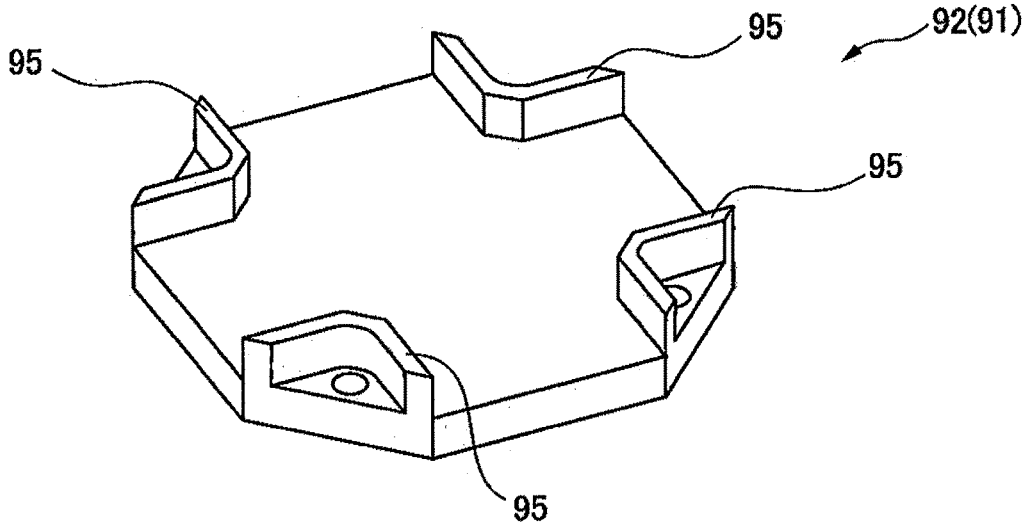
FIG. 12 is a perspective view of a plate-like member according to another embodiment.

As can be seen in FIG. 4 and FIG. 11, in the first and second embodiments, the rod-like member 93 is inserted into a hole formed in the protrusion 95. However, the rod-like member 93 does not necessarily pass through the protrusion 95. For example, the protrusion 95 of the plate-like member 91 or 92 in FIG. 12, which is a perspective view of a plate-like member according to another embodiment, has a wall formed partially around a hole into which a rod-like member 93 is inserted. The protrusion 95 illustrated in FIG. 12 also has an inner side portion that comes into contact with the iron core 41 and has an effect similar to that previously described. Even the protrusion 95 having another shape with an inner side portion that comes into contact with the iron core 41 is included in the scope of the present invention.

Figure 13:
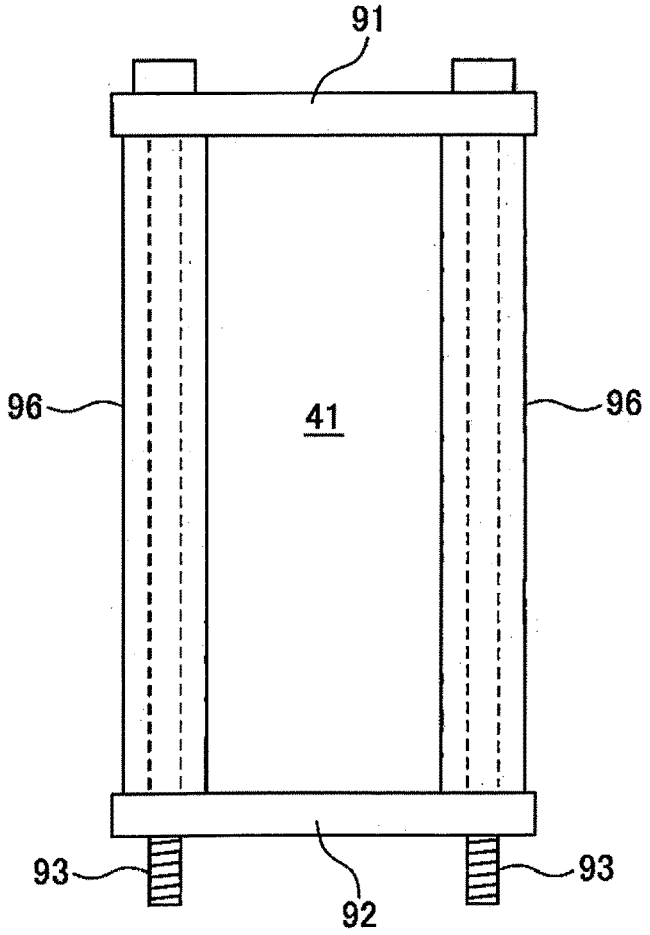
FIG. 13 is a cross-sectional view of a fixture and an iron core in a reactor according to yet another embodiment.

FIG. 13 is a cross-sectional view of a fixture and an iron core in a reactor according to yet another embodiment. The plate-like members 91 and 92 illustrated in FIG. 13 include no protrusion 95. Instead of the protrusions 95, the rod-like member 93 is inserted into a tube member 96. The tube member 96 extends at least partially in an axial direction of the rod-like member 93 between the plate-like members 91 and 92. The tube member 96 preferably has a radius that is substantially equal to or slightly more than a distance from a center line of the rod-like member 93 to the iron core. In addition, the tube member 96 is preferably formed of the same material as the protrusion 95 described above, for example, a resin.

As illustrated in FIG. 13, an outer circumferential face of the tube member 96 comes into contact with a side face of an iron core 41, so the plate-like members 91 and 92 are less likely to easily bend. Thus, the plurality of iron cores 41 to 43 can be firmly held by the fixture 90 while the generation of vibration and noise during use of the reactor 6 is suppressed. In addition, a structure with the tube member 96 disposed around the rod-like member 93 connected to the plate-like members 91 and 92 each provided with the protrusion 95 is also included in the scope of the present invention. Further, even a structure in which the plurality of iron cores 41 to 43 (44) are coupled to the outer peripheral iron core portion 20 of a single member is included in the scope of the present invention.

Aspects of the Disclosure

According to a first aspect, there is provided a reactor including a core main body (5), the core main body having: an outer peripheral iron core (20) composed of a plurality of outer peripheral iron core portions (21 to 24); at least three iron cores (41 to 44) coupled to inner faces of the plurality of outer peripheral iron core portions; and coils (51 to 54) wound around the at least three iron cores, the at least three iron cores respectively having radial inner end portions positioned near a center of the outer peripheral iron core, converging toward the center of the outer peripheral iron core, a gap (101 to 104) being formed between one iron core of the at least three iron cores and another iron core adjacent to the one iron core, the gap being magnetically coupled, the radial inner end portions of the at least three iron cores being spaced apart from each other with the gap being magnetically coupled, the reactor further including a fixture (90) that fixes both end portions of the at least three iron cores together by passing through an interior of the outer peripheral iron core in a region between the outer peripheral iron core and the gap, the fixture having: plate-like members (91, 92) disposed on both end faces of the core main body; and rod-like members (93) connecting the plate-like members to each other by passing through the interior of the outer peripheral iron core, and the plate-like members each including a protrusion (95) extending axially inward of the core main body.

According to a second aspect, the first aspect is configured such that an inner side face of the protrusion is in contact with the iron core corresponding to the protrusion.

According to a third aspect, the first or second aspect is configured such that the plate-like members and the protrusion are each formed of an insulating material.

According to a fourth aspect, any one of the first to third aspects is configured such that the rod-like members are each inserted into a tube member (96) between the plate-like members.

According to a fifth aspect, there is provided a reactor including a core main body (5), the core main body having: an outer peripheral iron core (20) composed of a plurality of outer peripheral iron core portions (21 to 24); at least three iron cores (41 to 44) coupled to inner faces of the plurality of outer peripheral iron core portions; and coils (51 to 54) wound around the at least three iron cores, the at least three iron cores respectively having radial inner end portions positioned near a center of the outer peripheral iron core, converging toward the center of the outer peripheral iron core, a gap (101 to 104) being formed between one iron core of the at least three iron cores and another iron core adjacent to the one iron core, the gap being magnetically coupled, the radial inner end portions of the respective at least three iron cores being spaced apart from each other with the gap being magnetically coupled, the reactor further including a fixture (90) that fixes both end portions of the at least three iron cores together by passing through an interior of the outer peripheral iron core in a region between the outer peripheral iron core and the gap, the fixture having: plate-like members (91, 92) disposed on both end faces of the core main body; and rod-like members (93) connecting the plate-like members to each other by passing through the interior of the outer peripheral iron core, the rod-like members each being inserted into a tube member (96) between the plate-like members.

According to a sixth aspect, the fifth aspect is configured such that the rod-like members are each made of metal.

According to a seventh aspect, any one of the first to sixth aspects is configured such that the number of the at least three iron core coils is a multiple of three.

According to an eighth aspect, any one of the first to sixth aspects is configured such that the number of the at least three iron core coils is an even number of four or more.

According to a ninth aspect, a method for manufacturing a reactor includes: preparing at least three iron cores coupled to a plurality of outer peripheral iron core portions constituting an outer peripheral iron core; inserting the at least three iron cores respectively into the at least three coils; forming a core main body by assembling the plurality of outer peripheral iron core portions; attaching a rod-like member to a first plate-like member provided with a protrusion extending inward in an axial direction of the core main body; disposing the first plate-like member on one end of the outer peripheral iron core, by passing the rod-like member through an interior of the outer peripheral iron core; and fixing both end portions of the at least three iron cores together by attaching a second plate-like member to the rod-like member protruding from the other end of the outer peripheral iron core, thereby manufacturing the reactor.

According to a tenth aspect, a method for manufacturing a reactor includes: preparing at least three iron cores coupled to a plurality of outer peripheral iron core portions constituting an outer peripheral iron core; inserting the at least three iron cores respectively into the at least three coils; forming a core main body by assembling the plurality of outer peripheral iron core portions; attaching a rod-like member to a first plate-like member; inserting the rod-like member into a tube member; disposing the first plate-like member on one end of the outer peripheral iron core by passing the rod-like member inserted into the tube member through an interior of the outer peripheral iron core; and fixing both end portions of the at least three iron cores together by attaching a second plate-like member to the rod-like member protruding from the other end of the outer peripheral iron core, thereby manufacturing the reactor.

Effects of Aspects

In the first and ninth aspects, the protrusion extends axially inward of the core main body. Thus, even when the rod-shaped members and the plate-like members are connected, the plate-like members are less likely to easily bend. Accordingly, the plurality of iron cores can be firmly held while the generation of vibration and noise is suppressed.

In the second aspect, the plurality of iron cores can be held more firmly.

In the third aspect, the generation of heat in the reactor can be suppressed.

In the fourth aspect, the plurality of iron cores can be firmly held.

In the fifth and tenth inventions, the outer circumferential face of the tube member is in contact with the side face of the iron core, so the plate members are less likely to easily bend. Thus, the plurality of iron cores can be firmly held by the fixture while the generation of vibration and noise during use of the reactor is suppressed.

In the sixth aspect, the strength of the rod-like member against tension applied when the rod-like member is fixed increases, so the fixing of the core can be held more firmly.

In the seventh aspect, the reactor can be used as a three-phase reactor.

In the eighth aspect, the reactor can be used as a single-phase reactor.

While the invention has been described with reference to specific embodiments, it will be understood, by those skilled in the art, that various changes or modifications may be made thereto without departing from the scope of the claims described later.

The invention claimed is:

1. A reactor comprising
a core main body,
the core main body including:
an outer peripheral iron core composed of a plurality of outer peripheral iron core portions;
at least three iron cores coupled to inner faces of the plurality of outer peripheral iron core portions; and
coils wound around the at least three iron cores,
the at least three iron cores respectively having radial inner end portions positioned near a center of the outer peripheral iron core, converging toward the center of the outer peripheral iron core,
a gap being formed between one iron core of the at least three iron cores and another iron core adjacent to the one iron core, the gap being magnetically coupled,
the radial inner end portions of the at least three iron cores being spaced apart from each other with the gap being magnetically coupled,
the reactor further comprising
a fixture that fixes both end portions of the at least three iron cores together by passing through an interior of the outer peripheral iron core in a region between the outer peripheral iron core and the gap,
the fixture including:
plate-like members disposed on both end faces of the core main body; and
rod-like members connecting the plate-like members to each other by passing through the interior of the outer peripheral iron core,
the plate-like members each including a protrusion extending axially inward of the core main body.

2. The reactor of claim 1, wherein
an inner side face of the protrusion is in contact with the iron core corresponding to the protrusion.

3. The reactor of claim 1, wherein
the plate-like members and the protrusion are each formed of an insulating material.

4. The reactor of claim 1, wherein
the number of the at least three iron core coils is a multiple of three.

5. The reactor of claim 1, wherein
the number of the at least three iron core coils is an even number of four or more.

* * * * *